US008373609B1

(12) United States Patent
Dorsey et al.

(10) Patent No.: US 8,373,609 B1
(45) Date of Patent: Feb. 12, 2013

(54) PERTURBED SQUARE RING SLOT ANTENNA WITH RECONFIGURABLE POLARIZATION

(75) Inventors: W Mark Dorsey, Elkridge, MD (US); Amir I Zaghloul, Bethesda, MD (US); Mark G Parent, Port Tobacco, MD (US)

(73) Assignees: The United States of America, as represented by the Secretary of the Navy, Washington, DC (US); Virginia Tech Intellectual Properties, Inc., Blacksburg, VA (US)

( * ) Notice: Subject to any disclaimer, the term of this patent is extended or adjusted under 35 U.S.C. 154(b) by 669 days.

(21) Appl. No.: 12/481,025

(22) Filed: Jun. 9, 2009

Related U.S. Application Data

(60) Provisional application No. 61/060,289, filed on Jun. 10, 2008.

(51) Int. Cl.
*H01Q 13/10* (2006.01)

(52) U.S. Cl. ..... 343/769

(58) Field of Classification Search ..... 343/700 MS, 343/767, 768, 769, 770
See application file for complete search history.

(56) References Cited

U.S. PATENT DOCUMENTS

| | | | | |
|---|---|---|---|---|
| 4,379,296 | A | 4/1983 | Farrar et al. | |
| 4,728,960 | A | 3/1988 | Lo | |
| 5,596,336 | A | 1/1997 | Liu | |
| 7,187,337 | B2 * | 3/2007 | Aikawa et al. | 343/767 |
| 7,535,326 | B2 | 5/2009 | Nakatani et al. | |

FOREIGN PATENT DOCUMENTS

WO WO0120718 A1 * 3/2001

OTHER PUBLICATIONS

S.H. Hsu and K. Chang, "A Novel Reconfigurable Microstrip Antenna with Switchable Circular Polarization", IEEE Antennas and Wireless Propagation Let., vol. 6, pp. 160-162 (2007).

Y.J. Sung, T.U. Jang, and Y.S. Kim, "A Reconfigurable Microstrip Antenna for Switchable Polarization", IEEE Microwave & Wireless Components Let., vol. 14, pp. 534-536 (Nov. 2004).

S.T. Fang, "A Novel Polarization Diversity Antenna for WLAN Applications", Antennas and Prop. Society International Symposium, vol. 1, pp. 282-285 (Jul. 2000).

F. Yang and Y. Rahmat-Samii, "A Reconfigurable Patch Antenna Using Switchable Slots for Circular Polarization Diversity", IEEE Microwave and Wireless Components Letters, vol. 12, No. 3, pp. 96-98 (Mar. 2002).

M. Niroojazi and M.N. Azarmanesh, "Practical Design of Single Feed Truncated Corner Microstrip Antenna", Proceedings of the Second Annual Conference on Communication Networks and Services Research, vol. 00, pp. 25-29.

P.C. Sharma and K.C. Gupta, "Optimized Design of Single Feed Circularly Polarized Microstrip Patch Antennas", Antennas and Propagation Society International Symposium, vol. 20, pp. 156-159 (May 1982).

(Continued)

*Primary Examiner* — Robert Karacsony
(74) *Attorney, Agent, or Firm* — Amy L. Ressing; L. George Legg

(57) ABSTRACT

A reconfigurable polarization antenna includes a microwave dielectric substrate having a ground plane that has a centrally located slot with five conducting patches, four of which form an evenly spaced apart perimeter group with a gap between each and the fifth, centrally positioned conducting patch. A conducting pad is positioned in each gap and is connected via a switch to the ground plane. A microstrip feed line including a short stub is positioned on the opposite side of the substrate and electromagnetically coupled to the slot. The polarization of the antenna is reconfigured by a selection of an on or off state of each of said switches.

13 Claims, 11 Drawing Sheets

OTHER PUBLICATIONS

J.S. Row, "The Design of a Squarer-Ring Slot Antenna for Circular Polarization", IEEE Transactions on Antennas and Propagation, vol. 53, No. 6, pp. 1967-1972 (Jun. 2005).

R.M. Sorbello and A.I. Zaghloul, "Wideband, High-Efficiency, Circularly Polarized Slot Elements", Antennas and Propagation Society International Symposium, vol. 3, pp. 1473-1476 (Jun. 1989).

Fries, Grani, and Vahldieck presented an annular slot antenna with switchable polarization in "A Reconfigurable Slot Antenna With Switchable Polarization", IEEE Microwave and Wireless Components Letters, vol. 13, No. 11, pp. 490-492 (Nov. 2003).

* cited by examiner

PERTURBED SQUARE RING SLOT ANTENNA WITH RECONFIGURABLE POLARIZATION

CROSS-REFERENCE TO RELATED APPLICATIONS

This Application claims the benefit of U.S. Provisional Application 61/060,289 filed on Jun. 10, 2008.

BACKGROUND OF THE INVENTION

The invention is directed to an antenna with reconfigurable polarization, and more particularly, to an antenna having a perturbed square ring slot configuration for operating in multiple polarizations.

Circular polarized (CP) antennas are popular choices in mobile wireless communications applications owing to their ability to allow flexible orientation between the transmitter and receiver antennas and to reduce multipath effects that can lead to signal fading, e.g. as described in S. H. Hsu and K. Chang, "A Novel Reconfigurable Microstrip Antenna with Switchable Circular Polarization", IEEE Antennas and Wireless Propagation Let., Vol. 6, 2007, pp. 160-162; Y. J. Sung, T. U. Jang, and Y. S. Kim, "A Reconfigurable Microstrip Antenna for Switchable Polarization", IEEE Microwave & Wireless Components Let., Vol. 14, November 2004, pp. 534-536 (hereinafter "Sung"); and S. T. Fang, "A Novel Polarization Diversity Antenna for WLAN Applications", Antennas and Prop. Society International Symposium, Vol. 1, 16-21 Jul. 2000, pp. 282-285. The ability to efficiently operate with both senses of CP (LHCP and RHCP) allows the system to reuse frequencies and double the system capacity, e.g. as described in F. Yang and Y. Rahmat-Samii, "A Reconfigurable Patch Antenna Using Switchable Slots for Circular Polarization Diversity", IEEE Microwave and Wireless Components Letters, Vol. 12, No. 3, March 2002, pp. 96-98 (hereinafter "Yang"). Moreover, if the antenna can be switched between two senses of CP as well as linear polarization, it will allow the user to roam to virtually any existing network, as described in Sung.

A printed circuit realization is ideal for wireless applications due to low profile, simple fabrication, low cost, and compatibility with integrated circuits. A common technique for achieving circular polarization is to feed the antenna in two locations with a 90 degree phase shift between the antenna ports. This technique has the drawbacks of requiring two feed lines as well as a hybrid network of some kind to provide the necessary phase shift. Single feed circular polarization has been realized in microstrip antennas through the introduction of a perturbation in opposing corners of the antenna, e.g. as described in M. Niroojazi and M. N. Azarmanesh, "Practical Design of Single Feed Truncated Corner Microstrip Antenna", Proceedings of the Second Annual Conference on Communication Networks and Services Research, Volume 00, pp. 25-29; P. C. Sharma and Kuldip C. Gupta, "Analysis and Optimized Design of Single Feed Circularly Polarized Microstrip Antennas", IEEE Transactions on Antennas and Propagation, Vol. AP-31, No. 6, November 1983, pp. 949-955; and P. C. Sharma and K. C. Gupta, "Optimized Design of Single Feed Circularly Polarized Microstrip Patch Antennas", Antennas and Propagation Society International Symposium, Volume 20, May 1982, pp. 156-159. These perturbations introduce a second near-degenerate mode. If the antenna is fed correctly, these modes can be generated with the same amplitude and a 90 degree phase difference resulting in CP. In these designs, the polarization is either RHCP or LHCP depending on the relationship between the feeding microstrip line and the truncated corners.

While traditional microstrip antennas provide a limited CP bandwidth, printed slot antennas can be more attractive elements in some cases because they provide an improved operating bandwidth without increasing the overall size of the element, e.g. as described in J. S. Row, "The Design of A Squarer-Ring Slot Antenna for Circular Polarization", IEEE Transactions on Antennas and Propagation, Vol. 53, No. 6, June 2005, pp. 1967-1972. These elements can then be perturbed to provide a wideband CP element by applying the principle of complementary structures to the previously mentioned perturbed class of microstrip structures, as described in R. M. Sorbello and A. I. Zaghloul, "Wideband, High-Efficiency, Circularly Polarized Slot Elements", Antennas and Propagation Society International Symposium, Vol. 3, 26-30 Jun. 1989, pp. 1473-1476.

Antennas with reconfigurable polarization have been a popular topic in the literature due to their applications in wireless communications devices. Fries, Grani, and Vahldieck presented an annular slot antenna with switchable polarization in "A Reconfigurable Slot Antenna With Switchable Polarization", IEEE Microwave and Wireless Components Letters", Vol. 13, No. 11, November 2003, pp. 490-492 (hereinafter "Fries"). An illustration taken from Fries is shown in FIG. 1. The authors present two configurations for this antenna. One antenna can switch between LHCP and RHCP. The other antenna configuration allows switching between either LHCP or RHCP and LP, but not all three states. Thus, each antenna can operate in a maximum of two polarization states.

Sung presents an antenna capable of switching between LHCP, RHCP, and LP by biasing PIN diode switches to select the desired truncations on a microstrip patch antenna. This design, shown in FIG. 2, operates with a bandwidth of less than 2%. Yang describes a microstrip antenna with polarization diversity, but their design is limited in switching between LHCP and RHCP, with no operation possible in LP.

There have been patents issued for antennas with switchable polarization. C. C. Liu, "Low Profile TEM Mode Slot Array Antenna", U.S. Pat. No. 5,596,336, issued 21 Jan. 1997, describes a slot array capable of switching polarizations. However, this design requires a polarizing screen to achieve CP, introducing an extra layer of complexity. Y. T. Lo, "Multifunctional Microstrip Antennas", U.S. Pat. No. 4,728,960, issued 1 Mar. 1988, describes multifunction microstrip antenna utilizing truncated corners, but these antennas do not have the ability to switch polarizations. FIG. 3 illustrates the antenna described in F. G. Farrar and D. H. Schaubert, "Selectable-mode microstrip antenna and selectable-mode microstrip antenna arrays", U.S. Pat. No. 4,379,296, issued 5 Apr. 1983, where the PIN diodes function as shorting posts at the desired locations and do not effectively change the shape of the radiator.

It would therefore be desirable to provide a reconfigurable antenna without such disadvantages.

BRIEF SUMMARY OF THE INVENTION

According to the invention, a reconfigurable polarization antenna includes a microwave dielectric substrate having a ground plane that has a centrally located slot with five conducting patches, four of which form an evenly spaced apart perimeter group with a gap between each and the fifth, centrally positioned conducting patch. A conducting pad is positioned in each gap and is connected via a switch to the ground plane. A microstrip feed line including a short stub is positioned on the opposite side of the substrate and electromagnetically coupled to the slot. The polarization of the antenna is reconfigured by a selection of an on or off state of each of said switches.

Also according to the invention is an N×N array of the reconfigurable polarization antennas. The array can be any value of N suitable for a particular application, e.g. anywhere from a 5×5 to a 15×15 array, although N can fall outside the stated ranges, depending as stated on the desired design performance.

The invention is directed to a perturbed slot with reconfigurable polarization that allows operation in LHCP, RHCP, or LP. This antenna topology is well-suited for wireless communications applications requiring polarization diversity. This design is realizable using cost effective printed circuit board technology making it an attractive design for low cost personal communications devices. Unlike previous ring slots with switchable perturbations that can only switch between two (2) polarization states, the perturbed square-ring slot antenna of the invention can be switched between RHCP, LHCP, or linear polarization (LP) by biasing a series of PIN diode switches, making it a more flexible design for wireless communication applications.

The invention provides a wide CP bandwidth, and also has the advantage of simplicity and low cost. The perturbed slot region can be easily printed on a microwave substrate, which is a low cost and highly reliable process. The only additional components are four (4) large capacitors and PIN diode switches, and then any additional components for the desired DC-biasing network.

The invention employs PIN diodes that provide conductivity between conducting patches to effectively change the shape of the radiator, while requiring only four (4) PIN switches, significantly less than alternative approaches.

DETAILED DESCRIPTION OF THE INVENTION

Figure 1A:
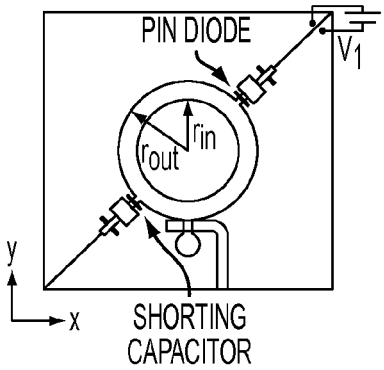
FIG. 1A PRIOR ART
FIG. 1 is a prior art annular slot antenna with switchable polarization.
Figure 1B:
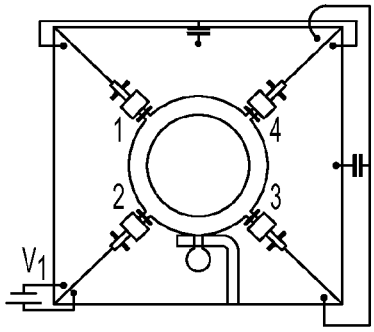
FIG. 1B PRIOR ART
Figure 2:
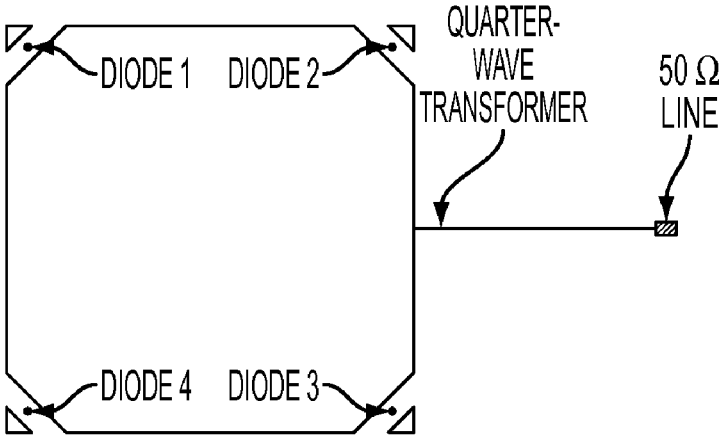
FIG. 2 PRIOR ART
FIG. 2 is a prior art microstrip patch switchable polarization antenna.
Figure 3:
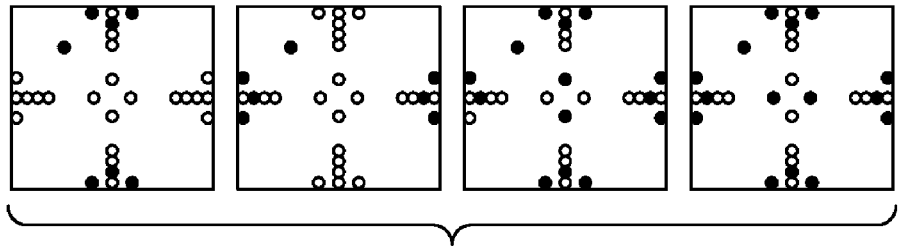
FIG. 3 PRIOR ART
FIG. 3 is a prior art microstrip patch switchable polarization antenna.
Figure 4A:
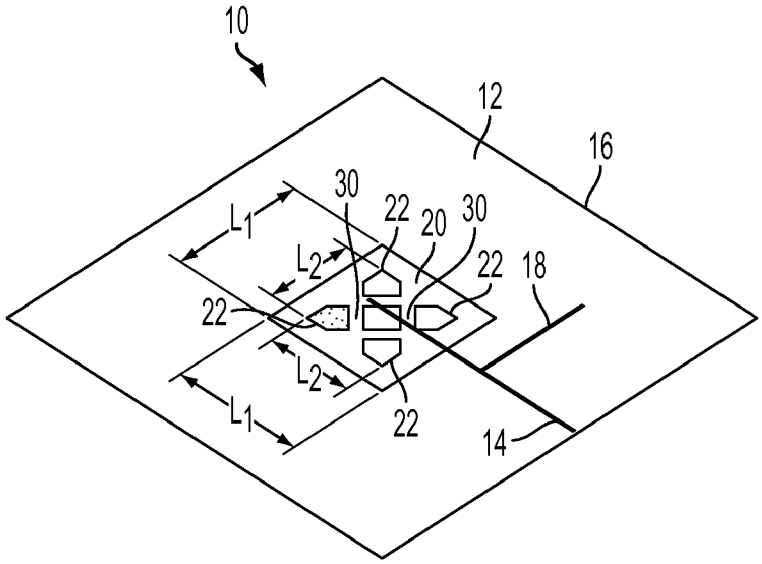
FIG. 4A is a sectional view showing details of the ground plane and the feeding microstrip line printed on opposite sides of a microwave substrate of an antenna according to the invention.
Figure 4B:
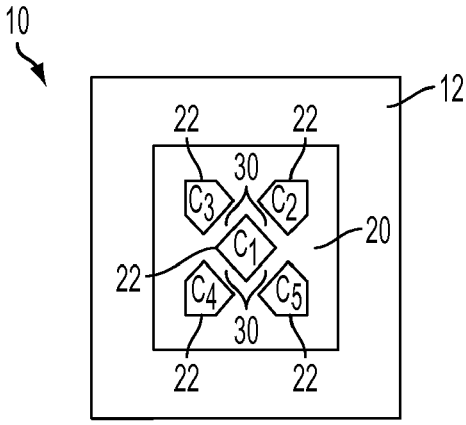
FIG. 4B is a top plan view of the perturbed slot separated into five conducting patches of an antenna according to the invention.
Figure 9:
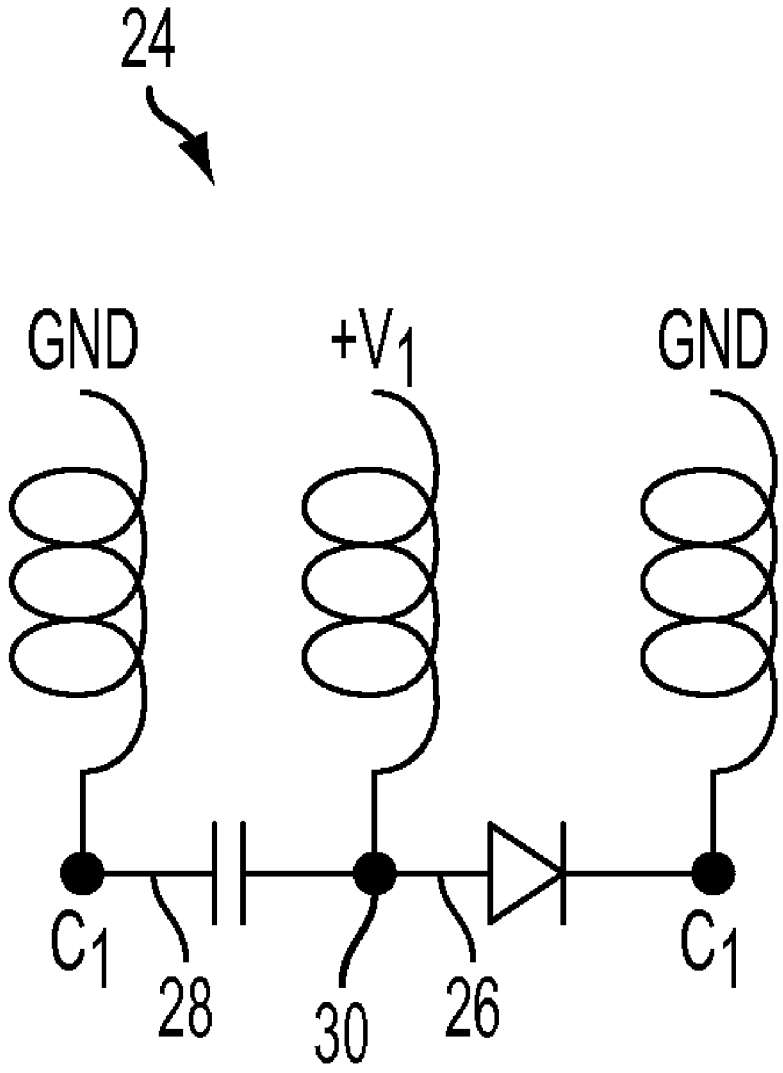
FIG. 9 is a circuit diagram of a PIN switch according to the invention.

The reconfigurable square-ring slot antenna 10 according to the invention is illustrated in FIG. 4. FIG. 4A shows the ground plane 12 and the feeding microstrip line 14 which are printed on opposite sides of a microwave substrate 16. The reconfigurable antenna designed by the inventor utilized a Rogers 4350 microwave substrate having a dielectric constant of 3.48. However, this design is not limited to that substrate. The microstrip line 14 contains a shunt stub 18 for matching. The stub 18 was added because the optimal axial ratio (AR) occurred outside of the optimal return loss bandwidth. The perturbed slot 20 is separated into five conducting patches 22 as seen in FIG. 4B. PIN diode switches 24 are placed between the center conducting patch ($C_1$) and the outer four conducting patches ($C_2$, $C_3$, $C_4$, and $C_5$). Referring also now to FIG. 9, these switches 24 consist of a PIN diode 26 in series with a large capacitor 28 which is used to maintain continuity between the RF grounded conductors while maintaining DC isolation. A small conducting pad 30 is located in between the PIN diode and the large capacitor, and is connected to the positive voltage through an inductor used as a RF choke. The five small conducting pads 30 are also DC grounded through inductors to maintain DC isolation. This biasing scheme is similar to that used in [10]. The switching could also be realized with microelectromechanical (MEMS) switches, e.g. such as are described in U.S. Pat. No. 7,535,326, Tadashi et al., issued Oct. 7, 2005, and incorporated herein by reference, placed between the conducting pads.

Figure 5:
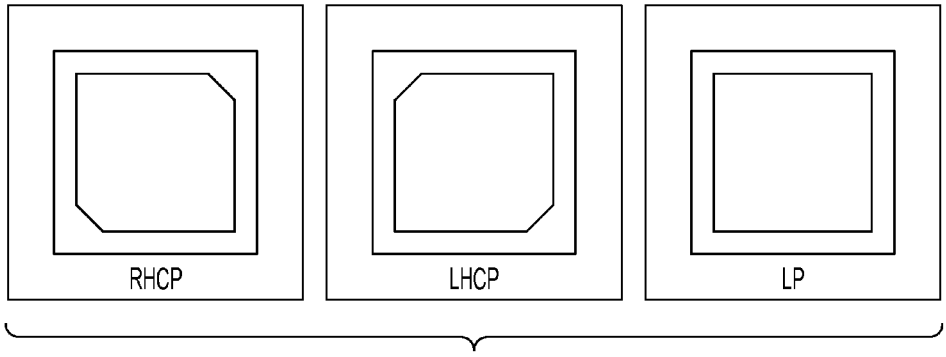
FIG. 5 is a schematic illustration of the polarization states of the alternate configurations of the antenna of FIGS. 4A-B.

A small conducting pad 30 is located in each gap between the center conducting patch ($C_1$) and each of the other four conducting patches ($C_2$, $C_3$, $C_4$, and $C_5$). The pads and the patches, as well as the feed line and other such structures described herein, are preferably formed on the dielectric substrate by printed circuit techniques, e.g. etching/lithography. As shown in FIG. 9 and described further below, a pad 30 is located in between the PIN diode and the large capacitor, and is connected to the positive voltage by a plated through hole to the DC circuitry located on the side of the microwave substrate containing the feed line. The effective shape of the perturbed center region—and thus the polarization—can be controlled by biasing the proper PIN diode switches. The possible polarization states (RHCP, LHCP and LP) and the corresponding diode switch states are tabulated in Table 1. These polarization states are illustrated in FIG. 5. When the switches between $C_1$-$C_2$ and $C_1$-$C_4$ are ON, the central region of the slot contains an effectively solid conductive region consisting of $C_1$, $C_2$, and $C_4$. When the switches are activated to achieve RHCP, the central region contains an effectively solid region between $C_1$, $C_3$, and $C_5$. When all switches are on, the center region contains a conductor consisting of $C_1$, $C_2$, $C_3$, $C_4$, and $C_5$ resulting in LP.

TABLE 1

Possible polarization states for Square Ring Slot With Reconfigurable Polarization

| Polarization | Switch from $C_1$ to $C_2$ | Switch from $C_1$ to $C_3$ | Switch from $C_1$ to $C_4$ | Switch from $C_1$ to $C_5$ |
|---|---|---|---|---|
| RHCP | OFF | ON | OFF | ON |
| LHCP | ON | OFF | ON | OFF |
| LP | ON | ON | ON | ON |

Figure 6A:
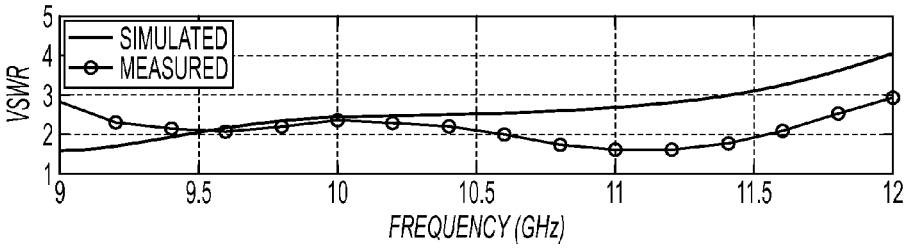
FIG. 6 is a graph of the voltage standing wave ratio (VSWR) for the alternate polarization states of the antenna according to the invention.
Figure 6B:
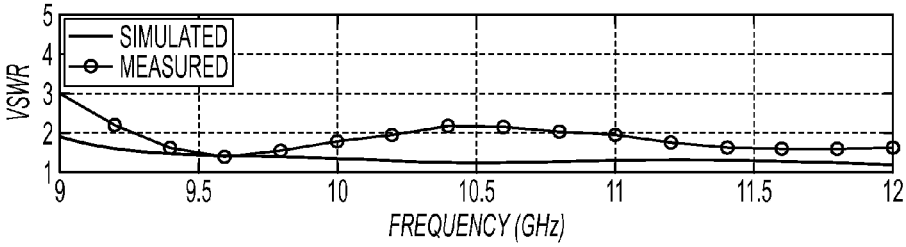
Figure 6C:
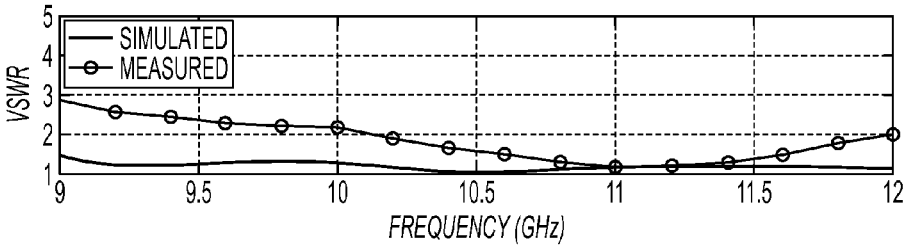
Figure 7:
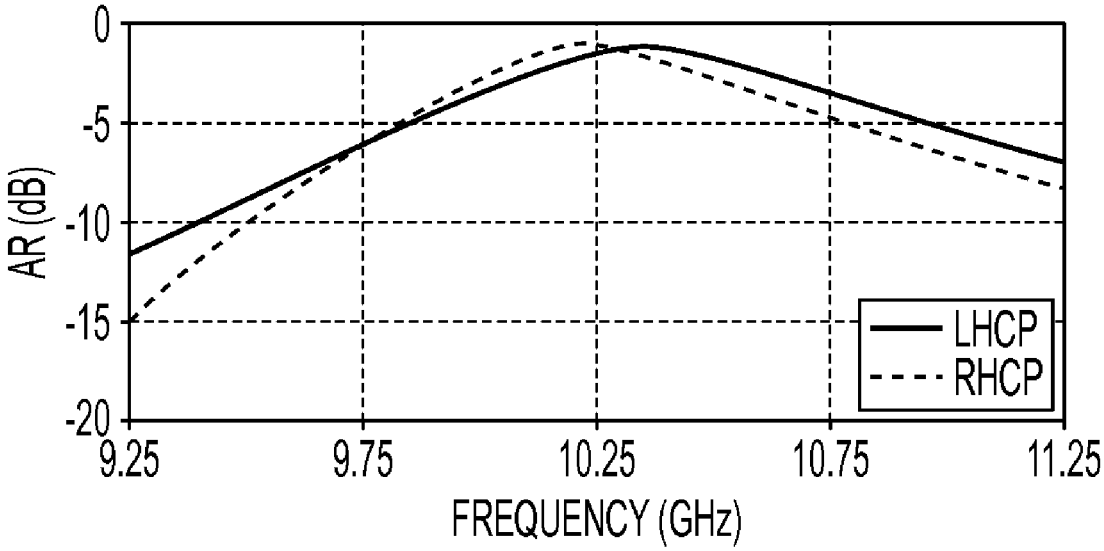
FIG. 7 is a graph of the axial ratio bandwidths for the two circular polarization (CP) states of the antenna according to the invention.
Figure 8A:
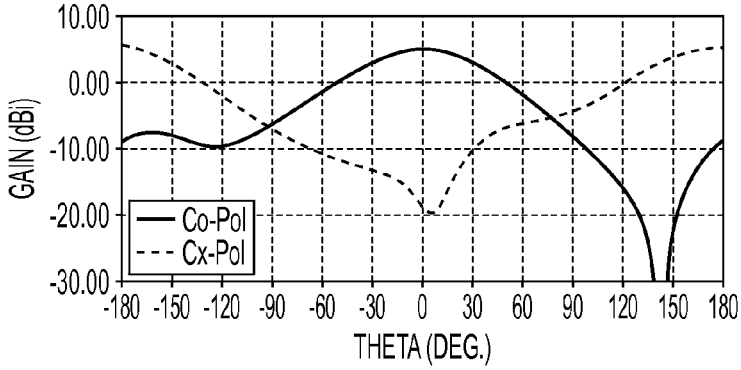
FIG. 8 are graphs showing the co- and cross-pol gain patterns for all three polarization configurations of the antenna according to the invention.
Figure 8B:
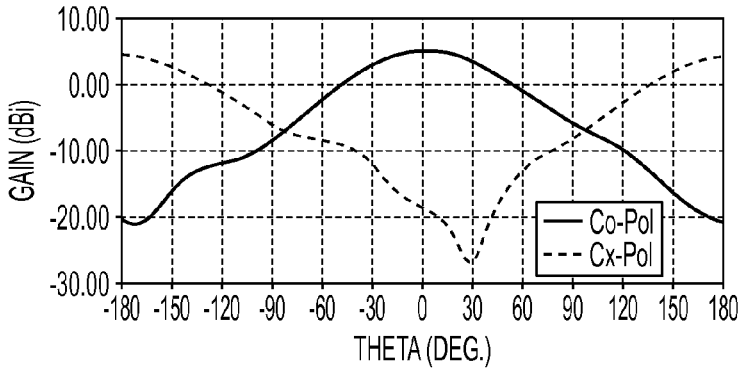
Figure 8C:
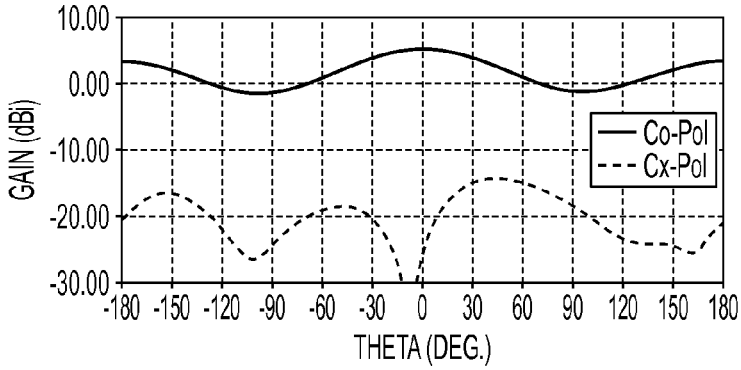

An X-Band element was designed and simulated using CST Microwave Studio [14]. The element used a Rogers R04350 microwave substrate ($\in_r$=3.48). In the simulations, the diode switches were modeled as lumped elements with the characteristic capacitance and resistance of PIN diode switches in either the ON or OFF state depending on the given polarization. This element was designed with CP operation in mind, so the matching stub was optimized to provide a low voltage standing wave ratio (VSWR) in this mode as reflected in FIG. 6. If LP was more important for a given application, the matching network could be redesigned to lower the VSWR in the LP mode. Both of the CP modes showed 3 dB axial ratio bandwidths of greater than 5% (5.1% for RHCP, 5.8% for LHCP) as seen in FIG. 7. This usable axial ratio bandwidth lies entirely within the region where the VSWR<1.5:1. FIG. 8 shows the co- and cross-pol gain patterns for this antenna in all three polarization configurations. The two CP states radiate the desired CP state in the upper half plane ($|\theta|<90°$), and the opposite sense in the lower half plane ($|\theta|>90°$). This is seen reflected in the high cross polarization levels in the lower half plane, and it results from the observation points in the lower half plane seeing the mirror image of the antenna seen in the upper half plane[10]. The LP gain pattern of FIG. 8(*c*) shows a cross-pol level of −35 dB on broadside. For applications requiring radiation in only a half-plane, the perturbed slot with switchable polarization could be realized in a stripline design. In this design, the bottom conductor of the stripline circuit would eliminate radiation in the lower half-plane.

The X-band element was printed on a microwave substrate having a thickness of 0.03". The substrate material was Rogers 4350—a dielectric, glass reinforced hydrocarbon/ceramic laminate microwave substrate with a dielectric constant of 3.48, or according to the manufacturer's specification, in the range of from 3.43 to 3.53. The design used 0.5 oz Copper on the microwave substrate. The 0.5 oz. copper cladding on the microwave substrate provides a thickness of 0.17 μm for all printed conductors (i.e. ground plane, conducting pads/patches, and feed line).

The substrate material, thickness, and copper weight can be chosen to meet specific criteria for the application and are not restricted to these selections.

Figure 10A:
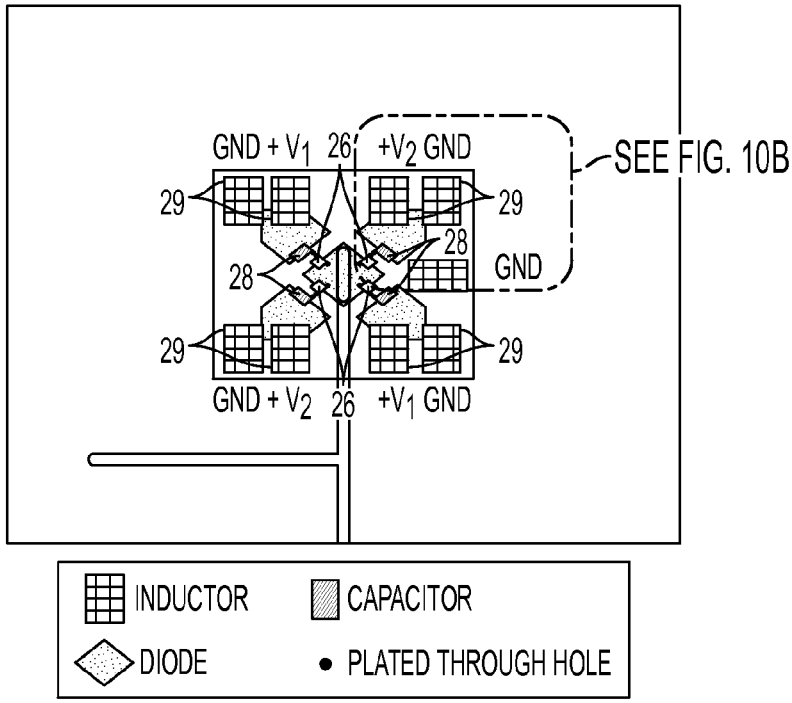
FIGS. 10A-B illustrate a conducting patch positioned between the PIN diode and the large capacitor according to the invention.
Figure 10B:
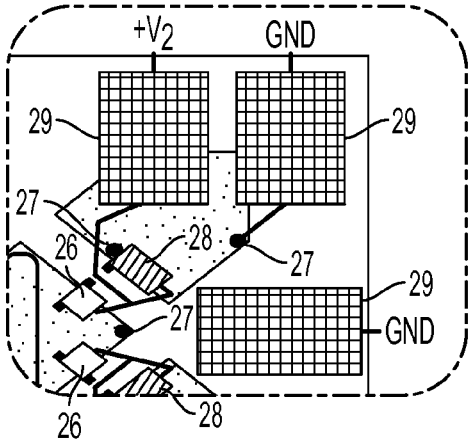

FIG. 9 shows a switch that consists of a PIN diode in series with a large capacitor to maintain continuity between the RF grounded conductors while maintaining DC isolation. FIGS. 10A-B show a conducting patch positioned between the PIN diode and the large capacitor. The conducting patch is connected to the positive voltage through an inductor used as a RF choke.

Figure 11A:
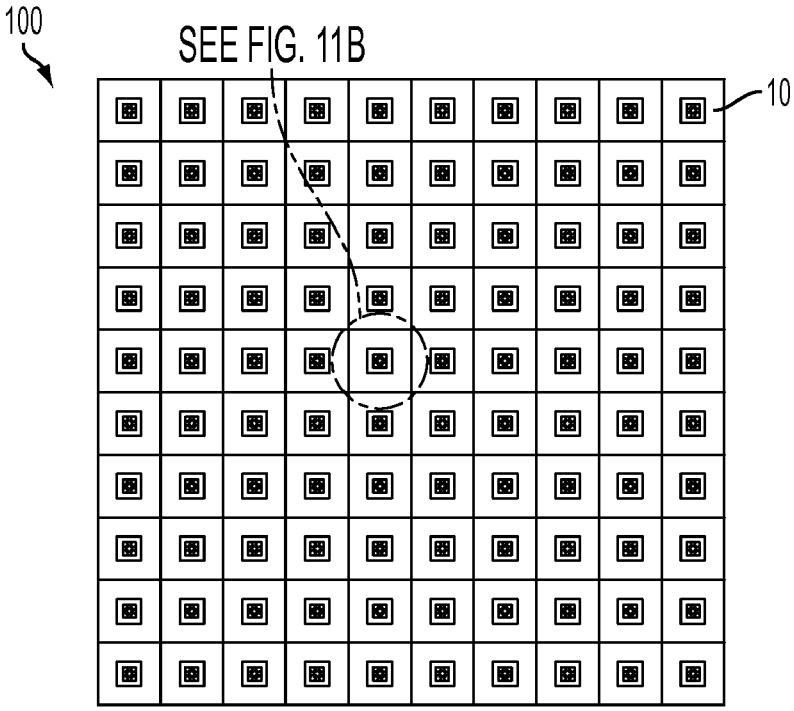
FIG. 11 illustrates an antenna array according to the invention.
Figure 11B:
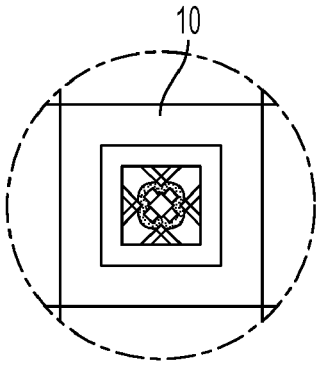

FIG. 11 shows an antenna array 100 that is a 10×10 array of antenna elements 10. Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. A reconfigurable polarization antenna, comprising:

a microwave dielectric substrate having a first surface and a second opposing surface;

a ground plane on the first surface including a single centrally located square ring slot, said slot including five conducting patches wherein four of said conducting patches form a substantially evenly spaced apart perimeter group around a fifth centrally located conducting patch and thereby forming a gap between each of said four conducting patches and said fifth conducting patch;

a microstrip feed line including a short stub on the second surface electromagnetically coupled to the slot; and a conducting pad in each gap connected via a switch to the ground plane, whereby the polarization of the antenna is reconfigured by a selection of an on or off state of each of said switches.

2. The antenna of claim 1, wherein each switch comprises a PIN diode in series with a large capacitor with a conducting pad connected therebetween and connected to a positive biasing voltage by a plated through hole in said substrate to a DC circuitry located on the second surface.

3. The antenna of claim 1, wherein each switch comprises a MEMS device.

4. The antenna of claim 1, wherein the ground plane, the conducting patches, the conducting pads, and the feed line are copper and each has a thickness of 0.17 microns.

5. The antenna of claim 1, wherein the antenna is switchable to polarization states that include right hand circular polarization, left hand circular polarization, and linear polarization.

6. A reconfigurable polarization antenna, comprising:

a microwave dielectric substrate having a first surface and a second opposing surface;

a ground plane on the first surface including a single centrally located square ring slot, said slot including five conducting patches wherein four of said conducting patches form a substantially evenly spaced apart perimeter group around a fifth centrally located conducting patch and thereby forming a gap between each of said four conducting patches and said fifth conducting patch;

a microstrip feed line including a short stub on the second surface electromagnetically coupled to the slot; and a conducting pad in each gap connected via a switch to the ground plane, whereby the polarization of the antenna is reconfigured by a selection of an on or off state of each of said switches, and wherein each switch comprises a PIN diode in series with a large capacitor with a conducting pad connected therebetween and connected to a positive biasing voltage by a plated through hole in said substrate to a DC circuitry located on the second surface.

7. The antenna of claim 6, wherein the ground plane, the conducting patches, the conducting pads, and the feed line are copper and each has a thickness of 0.17 microns.

8. The antenna of claim 6, wherein the antenna is switchable to polarization states that include right hand circular polarization, left hand circular polarization, and linear polarization.

9. A reconfigurable polarization antenna array, comprising:

an N×N array of antenna elements, with N a number selected from a range of 5 to 15, where each said element comprises:

a microwave dielectric substrate having a first surface and a second opposing surface;

a ground plane on the first surface including a single centrally located square ring slot, said slot including five conducting patches wherein four of said conducting patches form a substantially evenly spaced apart perimeter group around a fifth centrally located conducting patch and thereby forming a gap between each of said four conducting patches and said fifth conducting patch;

a microstrip feed line including a short stub on the second surface electromagnetically coupled to the slot; and a conducting pad in each gap connected via a switch to the ground plane, whereby the polarization of the antenna is reconfigured by a selection of an on or off state of each of said switches.

10. The antenna array of claim 9, wherein each switch comprises a PIN diode in series with a large capacitor with a conducting pad connected therebetween and connected to a positive biasing voltage by a plated through hole in said substrate to a DC circuitry located on the second surface.

11. The antenna array of claim 9, wherein each switch comprises a MEMS device.

12. The antenna array of claim 9, wherein the ground plane, the conducting patches, the conducting pads, and the feed line are copper and each has a thickness of 0.17 microns.

13. The antenna array of claim 9, wherein each said antenna element is switchable to polarization states that include right hand circular polarization, left hand circular polarization, and linear polarization.

* * * * *